United States Patent [19]

Hasegawa et al.

[11] Patent Number: 4,813,800

[45] Date of Patent: Mar. 21, 1989

[54] PAPER FEED APPARATUS FOR PRINTER

[75] Inventors: Kazumi Hasegawa, Tokyo; Hiroshi Ikeda, Tokorozawa; Wataru Ito, Koganei, all of Japan

[73] Assignee: Citizen Watch Co., Ltd., Tokyo, Japan

[21] Appl. No.: 95,393

[22] Filed: Sep. 10, 1987

[30] Foreign Application Priority Data

Sep. 10, 1986 [JP] Japan ..... 61-137932[U]

[51] Int. Cl.[4] ..... B41J 11/51

[52] U.S. Cl. ..... 400/606; 400/618; 400/607; 400/636.2

[58] Field of Search ..... 400/606, 607.3, 608.2, 400/608.4, 616, 616.1, 616.2, 616.3, 605, 618, 636.2, 607, 608.3

[56] References Cited

U.S. PATENT DOCUMENTS

| | | | |
|---|---|---|---|
| 1,213,189 | 1/1917 | Hart . | |
| 2,517,147 | 8/1950 | Vee . | |
| 2,664,988 | 1/1954 | Metzner | 400/618 |
| 3,972,460 | 8/1976 | Kesinger et al. | 400/616.3 X |
| 4,340,315 | 7/1982 | Teichmann et al. | 400/690.4 |
| 4,493,573 | 1/1985 | Hashimoto et al. | 400/647.1 |
| 4,666,322 | 5/1987 | Mitani | 400/639 |

FOREIGN PATENT DOCUMENTS

| | | | |
|---|---|---|---|
| 51-118512 | 10/1976 | Japan . | |
| 53-25107 | 3/1978 | Japan . | |
| 54-27808 | 3/1979 | Japan . | |
| 59-73980 | 4/1984 | Japan . | |
| 41148 | 2/1987 | Japan | 400/618 |
| 59058 | 3/1987 | Japan | 400/618 |

*Primary Examiner*—Edgar S. Burr
*Assistant Examiner*—James Lisehora
*Attorney, Agent, or Firm*—Lowe, Price, Leblanc, Becker & Shur

[57] ABSTRACT

A paper feed apparatus includes a plurality of guide ribs formed on a printer top cover disposed above a platen, the guide ribs being aligned along the axial direction of the platen, and a discharge roller is arranged between each pair of the guide ribs. Each discharge roller has its outer peripheral surface slightly extending toward corresponding guide ribs with respect to guide surfaces of these ribs and cooperating with the ribs to hold the printing paper. When the discharge rollers are driven in synchronism with rotation of the platen, the printing sheets are fed at a speed slightly higher than the paper feed speed of the platen. Therefore, the plurality of printing sheets can be simultaneously fed without causing a deviation therebetween.

2 Claims, 2 Drawing Sheets

PAPER FEED APPARATUS FOR PRINTER

BACKGROUND OF THE INVENTION

The present invention relates to a paper feed apparatus in a printer as a terminal output device and, more particularly, to a paper feed apparatus capable of simultaneously feeding a plurality of stacked sheets (to be referred to as copy paper hereinafter) without causing misalignment thereof It is very convenient to simultaneously obtain a plurality of prints when a printing head strikes a plurality of sheets However, it is difficult to simultaneously feed the sheets at a given speed. Strictly speaking, the radii of curvature of the sheets having arcuated feed paths on the outer surface of a platen differ from each other. A feed amount of the sheet on the platen side differs by a deviation D from that of the sheet on the side opposite to the platen when the sheets are simultaneously fed by the platen. More specifically, feeding of the inner sheet on the platen side is delayed from that of the outer sheet. As shown in FIG. 4, the deviation D between the sheets is defined as follows:

$$D=(n-1)t\cdot 2\pi\cdot(\theta/360)$$

where n is the number of sheets constituting copy paper a, t is the thickness of each sheet, and $\theta$ is the wound angle.

If t=0.1 (mm), n=4, and $\theta=120°$, then the deviation D=0.62 (mm) is generated every $\theta°$ rotation of the platen. This deviation D is theoretically accumulated when the platen is rotated further. However, according to an observation result, when the deviation D has reached 3 to 4 mm, a given saturation is achieved. Upon achieving a saturation, the sheets are fed while keeping this deviation. During feeding, perforated portions and perfect-bound portions which are provided normally at both sides of the copy paper can endure a tension force difference caused by the above deviation. In addition, elasticity of the paper itself often allows intermittent skips on the contact surface with the platen to prevent an infinite accumulation of deviations.

However, the deviation of 3 to 4 mm causes poor printing on paper. The above-mentioned skips are not allowed depending on the types of printers, and elasticity of the paper is not sufficient depending on the types of paper. Pin holes a' of the inner sheets are gradually deviated from those of the outer sheets, and finally paper jam occurs. Reference numeral 100 in FIG. 4 shows a printing head.

Prior arts for solving problems posed by a plurality of sheets to be printed are Japanese Patent Laid-Open Application Nos. 51-118512, 53-25107, and 54-27808 (to be referred to as prior arts (1), (2), and (3) hereinafter). In prior art (1), the deviation during feeding of printing paper consisting of a plurality of sheets is prevented by zig-zag feeding. In prior art (2), the deviation during feeding of printing paper consisting of a plurality of sheets is prevented after the edge of the paper is trimmed and the edge-trimmed paper is fed to the printing head. In prior art (3), the temporary bound portions of the printing paper consisting of a plurality of sheets are designed not to interfere with the printing head. Therefore, these prior arts presented problems to be solved and means for solving these problems, all of which are different from those of the present invention.

SUMMARY OF THE INVENTION

It is an object of the present invention to provide a paper feed apparatus for a printer wherein delay in feeding of an inner sheet from feeding of an outer sheet during feeding of a plurality of sheets can be solved.

According to the present invention, there is provided a paper feed apparatus for a printer wherein a plurality of printing sheets can be simultaneously fed.

The paper feed apparatus comprises a plurality of guide ribs formed on a printer top cover disposed above a platen, the guide ribs being aligned along the axial direction of the platen and being provided with guide surfaces for guiding printing paper, and a plurality of discharge rollers each arranged between corresponding ones of the plurality of guide ribs. Each discharge roller is disposed so that its outer peripheral surface slightly extends toward the corresponding guide ribs with respect to the guide surfaces of these ribs and the discharge roller cooperates with the corresponding guide surfaces to hold the printing paper by utilizing elasticity of the printing paper. The discharge rollers are driven in synchronism with rotation of the platen and feed the printing paper at a speed slightly higher than the paper feed speed of the platen.

DETAILED DESCRIPTION OF THE PREFERRED EMBODIMENT

An embodiment according to the present invention will be described with reference to the accompanying drawings.

Figure 1:
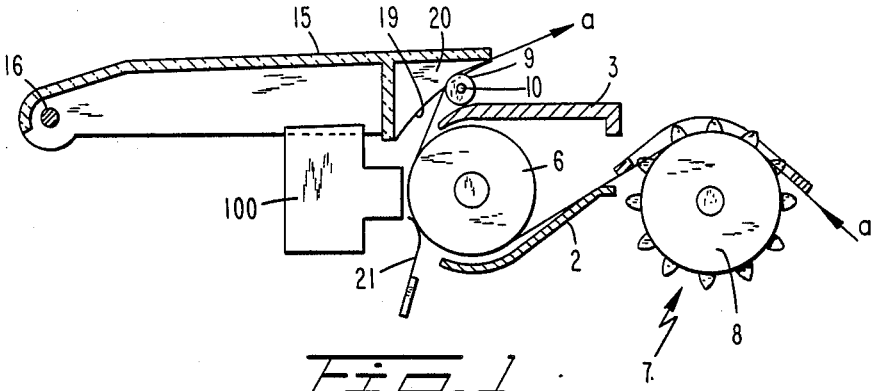
FIG. 1 is a schematic longitudinal sectional view showing the main part of a printer body equipped with a paper feed apparatus according to an embodiment of the present invention.
Figure 2:
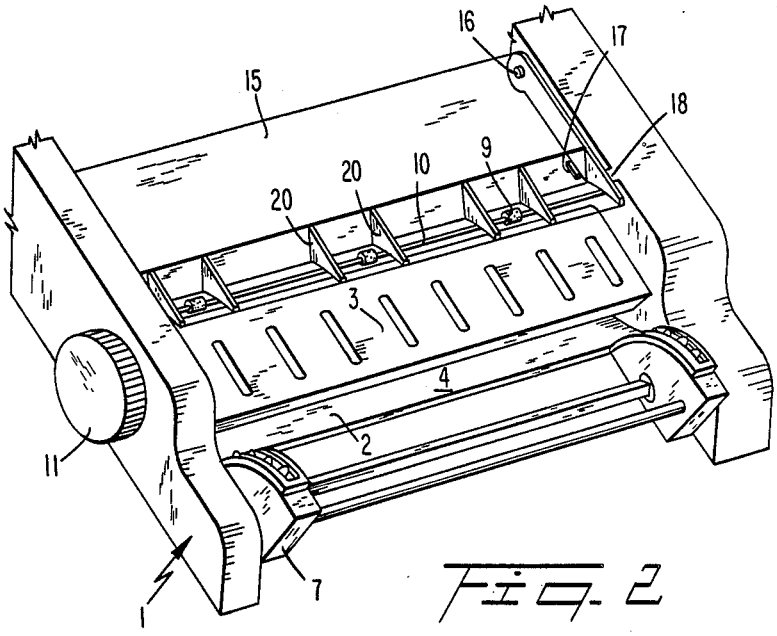
FIG. 2 is a schematic perspective view showing part of the printer body shown in FIG. 1.
Figure 3:
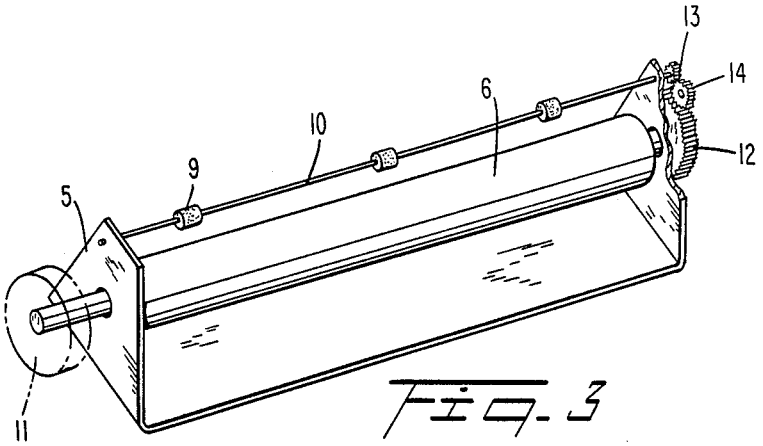
FIG. 3 is a schematic perspective view showing part of the paper feed apparatus shown in FIG. 1.
Figure 4:
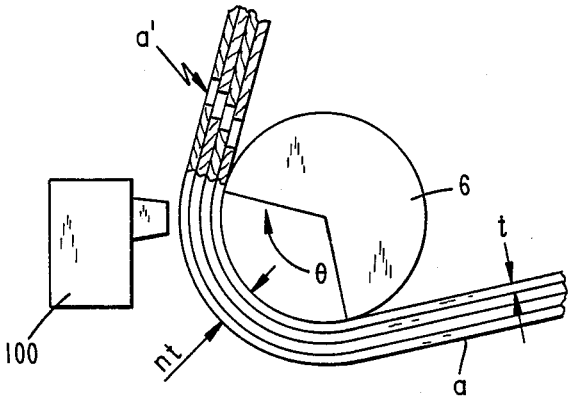
FIG. 4 is a view for explaining a deviation between sheets when a plurality of printing sheets are simultaneously fed.

FIG. 2 shows the rear portion of a printer body 1 equipped with a paper feed apparatus according to an embodiment of the present invention. In the printer body 1, a paper feed port 4 is formed between a paper guide plate 2 and a paper reception plate 3 which are disposed in parallel with each other and fixed to the printer body 1. A tractor 7 as a continuous form paper feeder faces the paper feed port 4. The tractor 7 comprises pin wheels 8 (FIG. 1). FIG. 3 shows part of the paper feed apparatus built into the printer body 1. A platen 6 and a discharge roller shaft 10 on which discharge rollers 9 are fixed are parallel to each other and rotatably supported by a frame 5 of the apparatus. The platen 6 is located below the paper reception plate 3 in front of the paper feed port 4. One end of a shaft of the platen 6 extends through the side wall of the printer body 1 and a platen knob 11 is mounted on the extended end of the platen shaft. A platen gear 12 is fixed on the other end of the shaft of the platen 6 (FIGS. 1 to 3). The platen gear 12 is adapted to be intermittently rotated by a drive motor (not shown) by a predetermined angular displacement at every predetermined timing.

The discharge roller shaft 10 having the discharge rollers 9 thereon is exposed above the paper reception plate 3 and hence the platen 6, as shown in FIGS. 1 to 3. A gear 13 is fixed to one end of the discharge roller shaft 10, and the gear 13 is meshed with the platen gear 12 through an idler gear 14. The direction of rotation of the discharge roller shaft 10 upon rotation of the gear 13 is the same as that of the platen 6. An angular displacement of the discharge roller 9 is slightly larger than a feed amount of the platen 6 by a difference between the feed amounts of the platen 6 and the discharge rollers 9.

Referring to FIG. 2, reference numeral 15 denotes a top cover for covering the printing head 100 (FIG. 1) and a carriage (not shown) for reciprocating the printing head along the axial direction of the platen 6. The top cover 15 is pivotal about pins 16 upward. When the top cover 15 is closed, it is fixed in position by a stopper 17 formed on the printer body 1 and a click stop 18 integrally formed with the printer body 1 and utilizing elasticity of its material. The top cover 15 is exemplified by a transparent cover in FIG. 2 to explicitly illustrate the structure of the guide ribs formed on the inner surface thereof.

Figure 5:
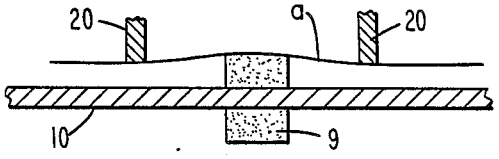
FIG. 5 is a schematic sectional view showing part of the paper feed apparatus so as to explain the positional relationship between guide ribs and a discharge roller.

As shown in FIGS. 1 and 2, the rear edge portion of the top cover 15 covers the discharge roller shaft 10. A plurality of triangular guide ribs 20 are formed on the rear edge portion and are spaced in the axial direction of the platen 6. The lower surface of each rib is constituted by a smoothly arcuated guide surface 19. The discharge rollers 9 mounted on the discharge roller shaft 10 are located between corresponding pairs of guide ribs 20. As shown in FIG. 5, each discharge roller 9 is disposed so that its outer peripheral surface slightly extends between corresponding guide surfaces 19 of the guide ribs 20 to overlap with these surfaces 19 in the radial direction of the roller 9. The copy paper a passing between the discharge rollers 9 and the guide surfaces 19 is urged against the discharge rollers 9 by elasticity of the paper.

Reference numeral 21 denotes a paper pressing member made of a spring material, for instance.

As shown in FIG. 1, the copy paper a is fed from the rear portion of the printer body 1 to the printer by the pin wheels 8 of the tractor 7. The copy paper a passes between a printing head 100 and the platen 6 through the paper guide plate 2 and is moved upward along the guide surfaces 19 of the guide ribs 20 in the paper discharge mechanism. The copy paper a finally reaches a position between the guide ribs 20 and the discharge rollers 9. When printing is initiated, the platen 6 and the pin wheels 8 of the tractors 7 are rotated by predetermined amounts upon every carriage return, so that the copy paper a can be vertically fed for one line. In this case, the discharge rollers 9 are rotated in synchronism with the rotation of the platen 6 in the same direction as that of the platen 6, but at a speed slightly higher than that of the platen 6. Therefore, the copy paper a, in particular, the inner sheets, urged against the rollers 9 by the guide ribs 20 is positively moved upward, thereby correcting the feeding delay of the inner sheets with respect to the outer sheets. The correction operation is performed upon every platen rotation, i.e., every paper feed.

The paper feed apparatus according to the present invention can also be a pin-belt type tractor or a friction roller brought into contact with the lower surface of the platen.

The paper feed apparatus according to the present invention has the following advantages:

(i) Since a deviation between the outer and inner sheets constituting the copy paper a upon pivotal movement of the platen 6 can be prevented, no positional errors in printing occur.

(ii) Since deviations in pin wheels of the inner sheets, formation of wrinkles, and damage to binding (e.g., adhesion and perfect binding) of inner sheets with outer sheets can be prevented, paper jam can be minimized.

(iii) Since the copy paper a can be held and fed by the paper feed apparatus even if the lower end of the paper is removed from the push roller for holding the paper with the platen at the lower portion of the platen, printing can be satisfactorily performed up to the lower end of the paper. Since the discharge rollers are brought into rolling contact with the lower surface of the inner paper sheet, the printed surface is not brought into slidable contact with the discharge rollers, thereby preventing contamination of the printed surfaces.

(iv) Since the paper feed apparatus need not be removed from and returned to the platen when the paper is loaded, unlike in a bail of a normal printer or a typewriter, the operation is very simple.

What is claimed is:

1. A paper feed apparatus for a printer, adapted to feed printing paper in the form of a plurality of stacked printing sheets, comprising:

a platen;

means for rotatively driving said platen;

a printer top cover disposed above said plated of said printer;

plurality of guide ribs formed on said printer top cover, said guide ribs being aligned along an axial direction of said platen and each including a guide surface for guiding said printing paper, each of said guide ribs being disposed so that its guide surface is brought in contact with an outermost one of the plurality of printing sheets with respect to said platen;

a plurality of discharge rollers each arranged between a corresponding pair of said plurality of guide ribs, each discharge roller having an outer peripheral surface slightly extending toward the corresponding pair of guide ribs with respect to the guide surfaces of these ribs and cooperating with the corresponding guide surfaces to hold the printing sheets by utilizing elasticity of the printing sheets, each of said discharge rollers being disposed for contact with an innermost one of the plurality of printing sheets with respect to said platen; and coupling means for coupling said discharge rollers to said platen so that said discharge rollers are driven in synchronism with rotation of said platen and at a speed higher than a rotation speed of said platen, said discharge rollers being operable to feed said innermost sheet at a speed slightly higher than a paper feed speed of said platen and enough to compensate for a deviation between at least one inner one of the printing sheets and at least one outer one thereof, said deviation being permitted to occur when the printing sheets are fed only by said platen.

2. An apparatus according to claim 1, further comprising:

a discharge roller shaft having an end thereof and supporting said discharge rollers;

wherein said platen has a platen shaft having an end thereof, and said coupling means includes a platen gear fixed to said end of said platen shaft, a gear fixed to said end of said discharge roller shaft, and an idle gear meshing with said gear and with said platen gear.

* * * * *